US010299036B2

(12) United States Patent
Colich

(10) Patent No.: US 10,299,036 B2
(45) Date of Patent: May 21, 2019

(54) PLANAR MAGNETIC ELECTRO-ACOUSTIC TRANSDUCER HAVING MULTIPLE DIAPHRAGMS

(71) Applicant: Audeze, LLC, Santa Ana, CA (US)

(72) Inventor: Dragoslav Colich, Orange, CA (US)

(73) Assignee: Audeze, LLC, Santa Ana, CA (US)

( * ) Notice: Subject to any disclaimer, the term of this patent is extended or adjusted under 35 U.S.C. 154(b) by 0 days.

(21) Appl. No.: 15/921,685

(22) Filed: Mar. 15, 2018

(65) Prior Publication Data

US 2018/0206029 A1 Jul. 19, 2018

Related U.S. Application Data

(63) Continuation of application No. 14/173,805, filed on Feb. 5, 2014, now Pat. No. 9,955,252.

(60) Provisional application No. 61/892,417, filed on Oct. 17, 2013.

(51) Int. Cl.

| | |
|---|---|
| ***H04R 9/06*** | (2006.01) |
| ***H04R 1/34*** | (2006.01) |
| ***H04R 9/02*** | (2006.01) |
| ***H04R 9/04*** | (2006.01) |
| ***H04R 7/20*** | (2006.01) |
| ***H04R 3/00*** | (2006.01) |
| *H04R 7/04* | (2006.01) |

(52) U.S. Cl.

CPC ..... *H04R 1/345* (2013.01); *H04R 3/00* (2013.01); *H04R 7/20* (2013.01); *H04R 9/025* (2013.01); *H04R 9/047* (2013.01); *H04R 9/048* (2013.01); *H04R 9/06* (2013.01); *H04R 7/04* (2013.01); *H04R 2201/34* (2013.01); *H04R 2209/024* (2013.01)

(58) Field of Classification Search

CPC . H04R 1/24; H04R 7/04; H04R 9/025; H04R 9/047; H04R 9/048; H04R 9/06; H04R 9/063; H04R 2209/024; H04R 2410/01; H04R 2410/03; H04R 2410/05

USPC ..... 381/176, 182, 186, 399, 401, 402, 408, 381/431; 181/157

See application file for complete search history.

(56) References Cited

U.S. PATENT DOCUMENTS 3,939,312 A 2/1976 McKay

*Primary Examiner* — Huyen D Le

(57) ABSTRACT

A multi-diaphragm planar magnetic electro-acoustic transducer is provided, having a plurality of diaphragms arranged in one or more diaphragm modules. Each diaphragm comprises a substrate and at least one electrically conductive circuit on at least one surface of the substrate. Each diaphragm module comprises at least one diaphragm, each held taut by a frame. Each diaphragm module is disposed to one side or the other of at least one planar magnetic array, the diaphragm module being parallel to and aligned with the planar magnetic array to form the multi-diaphragm planar magnetic transducer. The planar magnets many have a vertical arrangement, a sideways arrangement, a staggered arrangement, and may comprise stators and/or a low reluctance backing plate or channel piece. The planar magnet arrays can be linear or circular.

12 Claims, 11 Drawing Sheets

PLANAR MAGNETIC ELECTRO-ACOUSTIC TRANSDUCER HAVING MULTIPLE DIAPHRAGMS

CROSS-REFERENCE TO RELATED APPLICATIONS

This application is a continuation of and claims the benefit of U.S. patent application Ser. No. 14/173,805, entitled "Planar Magnetic Electro-Acoustic Transducer Having Multiple Diaphragms", filed on Feb. 5, 2014 and incorporated by reference, which in turn claims the benefit of U.S. Provisional Application No. 61/892,417, entitled, "Anti-Diffraction and Phase Correction Structure for Planar Magnetic Transducers", filed on Oct. 17, 2013, and incorporated by reference as if fully set forth herein.

The entirety of these applications is not admitted to being prior art with respect to the present invention or disclosure by their mention in the cross-reference or background sections.

BACKGROUND

Field

The disclosure relates to devices, methods, and systems relating generally to planar magnetic transducers and more specifically to a planar magnetic transducer having a plurality of diaphragms.

Description of the Related Art

In some approaches, planar magnetic acoustic transducers use a flat, lightweight diaphragm suspended in a magnetic field, rather than a cone attached to a voice coil. The diaphragm in a planar magnetic transducer has a conductive circuit pattern that, when energized with an electric current, reacts with the magnetic field to create forces that move the diaphragm to produce sound. In some approaches, planar magnetic acoustic transducers use a flat, lightweight diaphragm suspended in a magnetic field, rather than a cone attached to a voice coil. The diaphragm in a planar magnetic transducer has a conductive circuit pattern that, when energized with an electric current, reacts with the magnetic field to create forces that move the diaphragm to produce sound.

Diaphragm material consists of a very thin, flexible, and durable substrate. One example material suitable for this purpose is Kapton® polyimide film, as manufactured and marketed by DuPont™ of Research Triangle Park, N.C. The substrate is provided with a thin layer of electrically conductive material that is either laminated to or deposited on one or both faces of the substrate. Thus, diaphragms most commonly comprise either two layers: the conductive, often metal, layer and the substrate; or three layers: the conductive layer, an adhesive layer, and the substrate layer. If both sides of the substrate are to have a conductive layer, this represents an additional layer, or two layers if there is an adhesive layer between the substrate layer and the conductive layer. The conductive layer (or layers) is etched or otherwise cut to produce the conductive circuit pattern, either before or after being attached to the substrate.

The magnetic field is typically produced by a planar array of bar magnets, the bar magnets spaced apart regularly, but aligned parallel to each other, the poles of the bar magnets oriented to be perpendicular to the layer the magnets form. The diaphragm is suspended above the magnets, and substantial portions of the electrically conductive circuit pattern run parallel to individual bar magnets, as when current passes through these portions of the circuit, an induced magnetic field will react with the field produced by the magnets, causing the conductor, and the attached diaphragm, to be drawn to or away from the magnets.

However, there are drawbacks to this classic planar magnetic acoustic transducer design. The electrically conductive pattern can only handle so much power without having to increase the amount of conductive material, which alters the frequency response of the diaphragm due to increased mass and stiffness of the conductive material. This places a limit on the amount of acoustic power that can be developed by a diaphragm. Additional limitations of this design include non-linearity caused by variations in magnetic flux density between individual magnets, and variations with distance from the magnets. Another limitation is that combinations of audio signals from different sources must be electrically mixed before being used to drive the single diaphragm through a single electrically conductive circuit pattern, or if multiple patterns are used, then current capacity of one has been sacrificed for the other. Still another limitation is that when such signals are mixed and provided to a common transducer (the diaphragm), they are both subject to that transducer's resonances and other responses, which may not be optimal for one signal or the other, requiring additional power and equalization to obtain a desired result.

Another drawback of the classic design is when used in noise cancellation systems, where a separate microphone, near the edge of a planar magnetic transducer, is used to detect noise, which is then to be cancelled for a listener by a conjugate signal being fed to the transducer. In such an embodiment, the position of the microphone is not well matched to the natural resonances and other tunings of the transducer, nor are the axes of the microphone and transducer well aligned, for the purpose of addressing noise coming from different directions equally well. If the diaphragm is used as both a microphonic detector (the input transducer) and as a speaker (the output transducer), whether through separate electrically conductive circuits or a common one, there are significant limitations in differentiating what portion of the input signal is the result of noise that should be cancelled, and what portion is induced by the output signal and non-linearity of the diaphragm and magnetic fields.

SUMMARY

Present aspects of the disclosure include a planar magnetic transducer with a plurality of diaphragms, each diaphragm having an electrically conductive circuit on at least one side, the diaphragms being each disposed in parallel with and in proximity to at least one planar magnet array. In some aspects, multiple planar magnet arrays are provided, the arrays being spaced apart and substantially in parallel with each other.

It is an object of present aspects of the disclosure to allow the planar magnetic transducer, used as a speaker, to develop more acoustic power than is possible with a particular amount of conductive material on a single diaphragm.

It is an object of present aspects of the disclosure to allow the planar magnetic transducer, used as a speaker, to render more than one output signal without those signals needing to be electrically mixed.

It is a further object of present aspects of the disclosure to provide individual diaphragms having different natural resonances and tuning as appropriate to such separate output signals.

It is an object of present aspects of the disclosure to allow at least one diaphragm to be used exclusively as an input transducer, to detect noise from the outside for the purpose of developing a cancellation signal to be fed to at least one other diaphragm.

It is an object of present aspects of the disclosure to permit a variety of planar magnetic arrangements to be used. It is another object of the present aspects of the disclosure to allow different spacing between consecutive diaphragms to permit different tunings for different diaphragms.

Present aspects of the disclosure satisfy these and other needs and provide further related advantages.

BRIEF DESCRIPTION OF THE DRAWINGS

The aspects of disclosure will be apparent upon consideration of the following detailed description taken in conjunction with the accompanying drawings, in which like referenced characters refer to like parts throughout, and in which.

DETAILED DESCRIPTION

Figure 1:
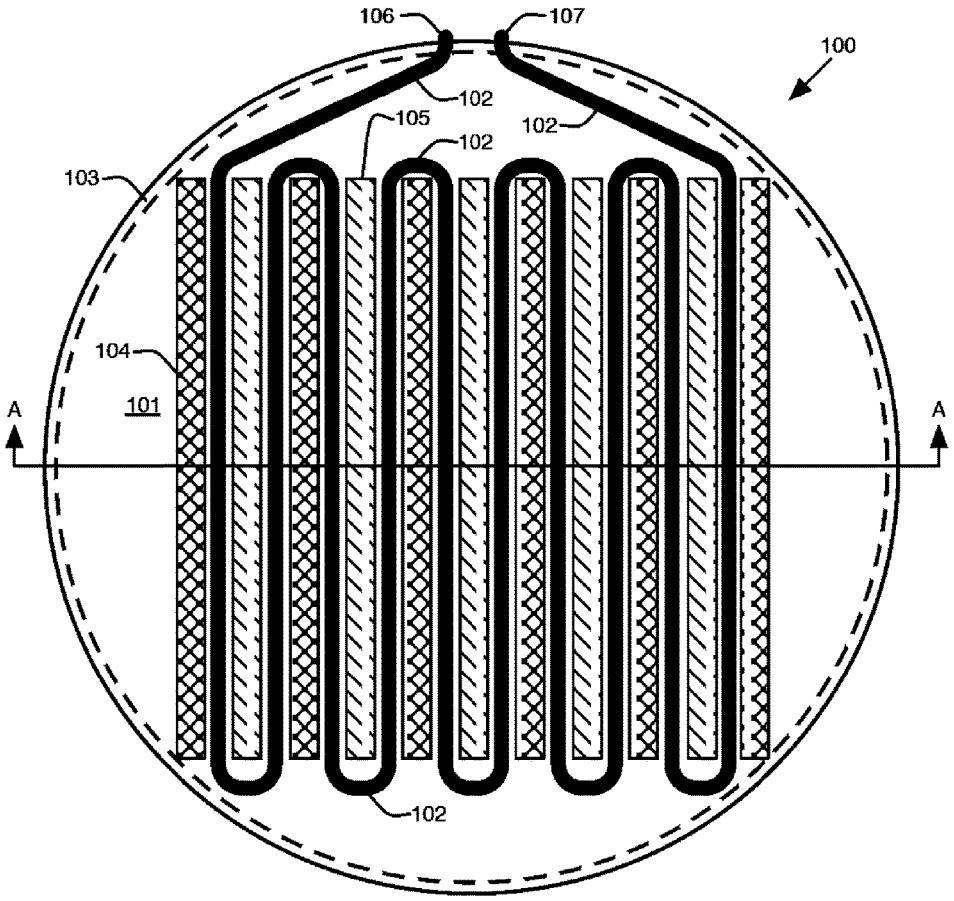
FIG. 1 shows one example of a single layer diaphragm assembly for a planar magnetic transducer, positioned near an example planar array of magnets, according to some aspects.

Referring to FIG. 1, a single layer diaphragm assembly 100 for a planar magnetic transducer is shown according to some aspects. The diaphragm assembly comprises the diaphragm substrate 101, held taut by frame 103, but does not include the array of magnets (e.g., magnets 104, 105). In some aspects, frame 103 is ring-shaped, though in alternative aspects, the frame can be rectangular or some other shape. In the view of FIG. 1, frame 103 is on the back side of diaphragm substrate 101. In some aspects, substrate 101 is glued to frame 103, but in other aspects, can be welded, clamped, or otherwise held to the frame to be kept taut.

The diaphragm assembly 100 further comprises an electrically conductive circuit 102, attached to one surface of the diaphragm substrate 101 (the facing surface in FIG. 1), whether by glue, adhesive membrane, deposition, or other mechanism. If needed, application of a conductive material can be followed by etching, for example, or laser ablation, as needed to remove excess conductive material and leave behind circuit 102. In this embodiment, circuit 102 terminates at 106, 107, as contacts where leads (not shown) can be attached or a connector (not shown) provided to electrically connect the planar magnetic transducer to a driver and/or detector circuit (not shown), and/or to other transducers. For example, some aspects may have one end 106 of circuit 102 connecting to another diaphragm assembly, while the other end 107 is connected to a driver circuit. In some aspects, the ends of circuit 102 may be inside the bounds of frame 103, or may pass through the perimeter of a frame (not frame 103 shown in FIG. 1, as circuit 102 is on the opposite side of substrate 101 from frame 103). In some aspects (none shown), perforations in substrate 101 may allow connections to circuit 102 to pass through one or more diaphragms.

In other aspects (none shown), more than one circuit such as circuit 102 can be provided on the same face of the diaphragm substrate 101 (not shown), each having its own ends, such as 106, 107 for circuit 102. Still other aspects (none shown) can have one or more circuits on the other face of substrate 101. Some aspects (none shown), may have a single circuit transition from one face of substrate 101, around the edge of the frame 103 (e.g., via leads), to the other face, thereby occupying both faces of substrate 101.

In alignment with portions of circuit 102, though not a part of the diaphragm assembly 100, is a planar array of magnets, here shown to be bar magnets, e.g. 104, 105. Some of the magnets, such as magnet 104, have their north pole headed out of the plane of FIG. 1, while others of the magnets, such as magnet 105, face the opposite direction and have north poles headed into the plane of FIG. 1, and as shown, the two types of magnets are alternately arranged in the array. The planar array of these alternating magnets is positioned in close proximity to diaphragm substrate 101. The array of magnets impose a patterned magnetic field in the proximity of the diaphragm substrate, such that, when properly aligned and at rest, a majority of circuit 102 traverses regions having a relatively consistent orientation and strength, as shown in and discussed in conjunction with FIGS. 2-9.

Figure 11:
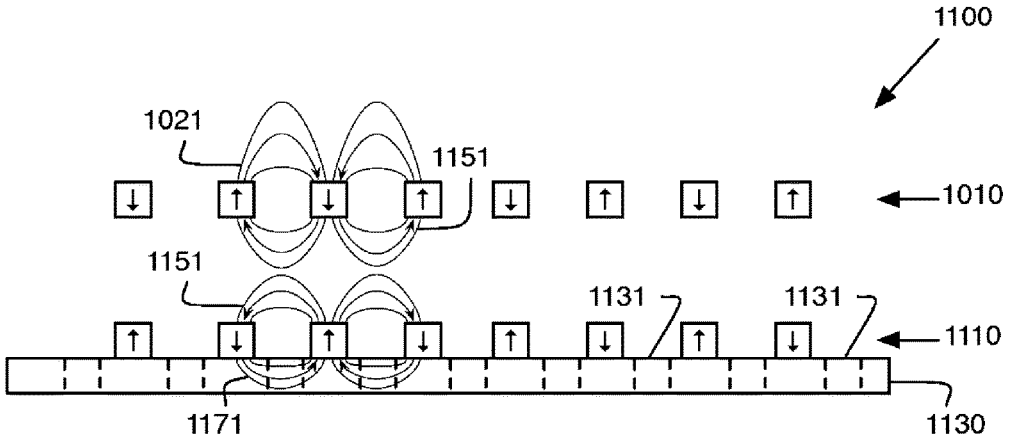
FIG. 11 shows a cross-section of a dual magnetic array according to some aspects.
Figure 14:
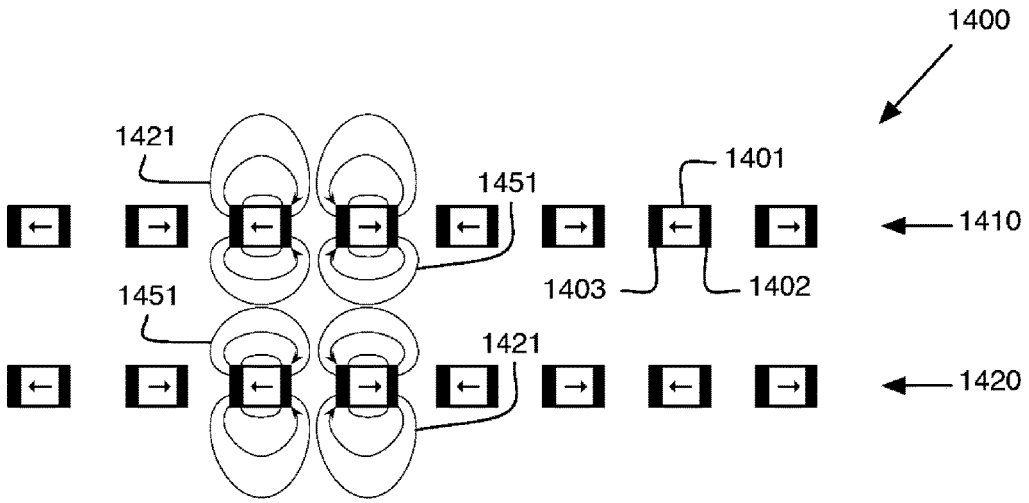
FIG. 14 shows a cross-section of a dual magnetic array having the poles of the magnets aligned in the plane of the array and having each magnet capped with stators, according to some aspects.

The mechanical mounting to maintain individual magnets, e.g., 104, 105, arranged in an array, is discussed here, but is not shown, except where FIGS. 11 and 14 illustrate two of the alternative aspects for such mounting, a backing plate and stators, respectively. In some aspects, bar magnets, such as 104, 105, can be held in place by end caps (none shown) that enclose, otherwise retain, or otherwise are attached to the ends or near-end sides of the bar magnets. An end cap can restrain the ends of one or more of the magnets in an array, to hold them in the correct orientation and in the correct spacing. The end caps can attach to a frame (e.g., 612 in FIG. 6) which is similar to diaphragm frame 103, and may attach to one or more adjacent diaphragm assemblies. In such an embodiment, the end caps (not shown) and frame (e.g., 612) hold the magnets (e.g., 104, 105) in proper alignment to and in proximity of one or more diaphragm assemblies, e.g., 100.

In aspects where the magnets of an array have one or both poles capped by a backing plate or stator (as shown in FIGS. 11, 14, respectively), the backing plate or stators can connect (not shown) to a frame (e.g., 612) and likewise function to keep the magnets in proper alignment and proximity of one or more diaphragm assemblies.

Still other aspects (none shown) can have different ways to hold the magnets creating the magnetic field in the correct position. For example, the bar magnets as shown may be parts of a monolithic piece, or several pieces comprising as portions of itself two or more of the bar magnets. For example, according to some aspects, the sub-arrays of oppositely oriented magnets, such as magnets 104, 105 shown in FIG. 1, are cast as combs of magnetic material, with each like-oriented bar magnet being replaced by a tine on such a comb. In some aspects, two combs interdigitate to produce the desired patterned magnetic field for circuit 102. In some aspects, these combs might be integrally attached to corresponding halves of the mounting frame (e.g., in lieu of frame 612). Many other mounting schemes for the individual magnets and planar arrays are possible, and may be used in aspects of the present disclosure.

Figure 2:
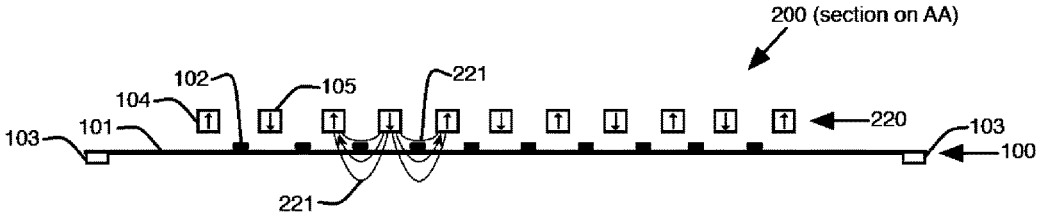
FIG. 2 shows a cross-section through the diaphragm assembly and planar array of magnets of FIG. 1, according to some aspects.

FIG. 2 shows a cross-section 200 at the section line AA of FIG. 1. Diaphragm assembly 100 is shown, with cross-sections of individual conductors of circuit 102 shown, and cross-sections of diaphragm mounting frame 103. Planar magnetic array 220 comprises magnets having their magnetic axis perpendicular to the plane of diaphragm assembly 100, but of alternating orientation, with magnets such as magnet 104 having their north pole directed away from diaphragm substrate 101, and magnets such as magnet 105 having their north pole directed toward the diaphragm substrate 101, in each case as shown by the arrow indicating polarity of the magnets in array 220. The arrangement of planar magnet array as shown in FIG. 2 is hereinafter referred to as a "vertical arrangement".

The magnetic field 221 impinging on a portion of the diaphragm assembly, and more particularly, in proximity to particular portions of circuit 102, is shown. Such an array 220 of such magnets creates a magnetic field that permits diaphragm assembly 100 to operate as an electro-acoustic transducer. In one example, a current flowing through circuit 102 interacts with the magnetic field that is crossing the circuit and results in a force mutually perpendicular to each, which in the case of section 200, will exert a force that causes diaphragm substrate 101 to move closer to, or further from planar magnetic array 220. Conversely, variations in the air pressure on opposite sides of the diaphragm substrate 101 (including such variations as caused by sound waves) resolve as a force causing diaphragm substrate 101 to move toward or away from planar magnetic array 220, causing conductive circuit 102 to traverse magnetic fields such as 221, resulting in electric current flow.

Figure 3:
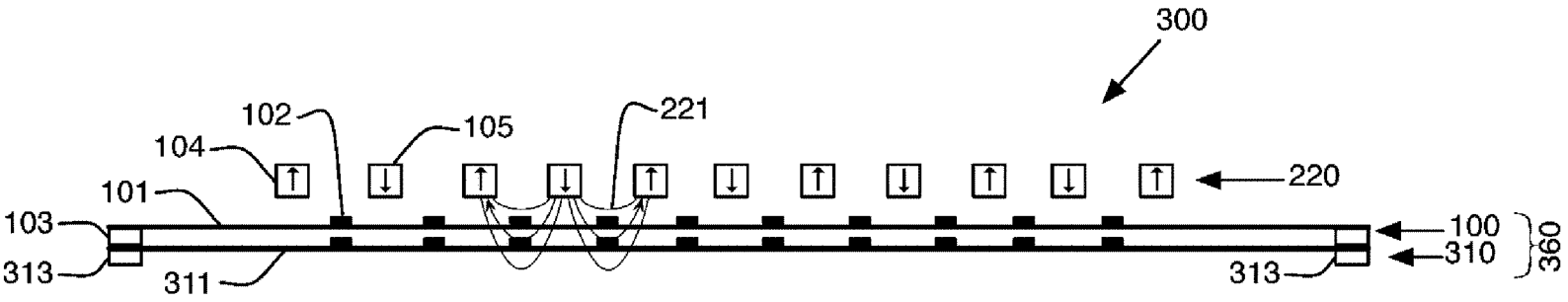
FIG. 3 shows a cross-section of one example multiple diaphragm assembly having two diaphragms positioned near a single planar magnet array, according to some aspects.

FIG. 3 shows a multi-diaphragm planar magnetic transducer 300, according to some aspects. Multi-diaphragm module 360 comprises two diaphragm substrates 101, 311, each with their own electrically conductive circuits (e.g., 102), here mounted on their respective frames 103, 313, as diaphragm assemblies 100, 310. In this embodiment, each of the diaphragm substrates 101, 311 passes through different regions of the same magnetic fields 221 from planar magnetic array 220.

In some preferred aspects, the thickness of the diaphragm frame 103, which here substantially establishes the distance between the adjacent diaphragm substrates 101, 311, can be from 0.1 mm to 3.0 mm, a range of distances that is beneficial for use when transducer 300 is scaled for application in a headphone. In the same situation, the spacing between the magnets of array 220 and the nearest diaphragm substrate 101, can likewise be 0.1 mm, to 3.0 mm. In larger applications, e.g., speakers, these dimensions may increase. In aspects where the circuits of adjacent diaphragm assemblies are being fed the same signals and so are expected to always operate in phase with each other, the inter-substrate dimension can be smaller than if the circuits are expected to operate on uncorrelated or out-of-phase signals. While particular ranges are described above with reference to preferred aspects, it will be understood by those of skill in the art that different distances may be employed to separate diaphragm substrates without departing from the scope or spirit of the disclosure.

In FIG. 3, diaphragm substrates 101 and 311 of this multi-diaphragm transducer are acoustically coupled through the air gap between them, and when driven with the same signals, both substrates 101 and 311 constructively contribute to the acoustic output of the multi-diaphragm transducer. The space between diaphragm substrates 101 and 311 may be sealed, which provides a so-called "isobaric" condition. (The term "isobaric" as used herein has the meaning found in the speaker industry; the definition from thermodynamics (i.e., where "isobaric" means having no change in pressure) would not apply here considering the short time scales and fine detail levels appropriate to sound propagation. Even when provided with one or more small ports, or when a slightly porous or permeable material is used to make diaphragm frame 103 or diaphragm substrate 101, for example, to allow gradual pressure equalization at different altitudes, the isobaric condition will still be dominant and will remain present for most audio frequencies (though at very low frequencies, sensitivity may be reduced in such a configuration). This property of a so-called "isobaric" condition allows multiple diaphragms, whether directly coupled (i.e., they are consecutive diaphragms) or indirectly coupled (i.e., separated by intervening diaphragms), when driven with the same signals, to constructively contribute to the acoustic output, thereby offering more available acoustic output power.

Physical properties such as substrate tension, thickness, material, details of the conductive circuit, including its static path relative to the magnetic fields, the electrical resistance, physical mass of the conductor, and shape of the frame and diaphragm substrate, may vary between diaphragm assemblies or within a diaphragm module without departing from the scope or spirit of the disclosure. For some aspects where such differences are intended, the variations allow, for different diaphragms of a multi-diaphragm transducer (e.g., 300) to be tuned differently to achieve different results. For example, different tunings allow one diaphragm of a multi-diaphragm transducer to have greater sensitivity to lower frequencies, and another diaphragm of the multi-diaphragm transducer to have greater sensitivity to higher frequencies. Further, changing the distance of each diaphragm assembly from planar magnets can change the strength of the magnetic fields it traverses, and can cause differences in the performance of the individual diaphragms as electro-acoustic transducers.

In an alternative embodiment, the two diaphragm substrates 101, 311 can be attached to the same frame 103, and frame 313 is not needed to keep diaphragm substrate 311 taut.

Figure 4:
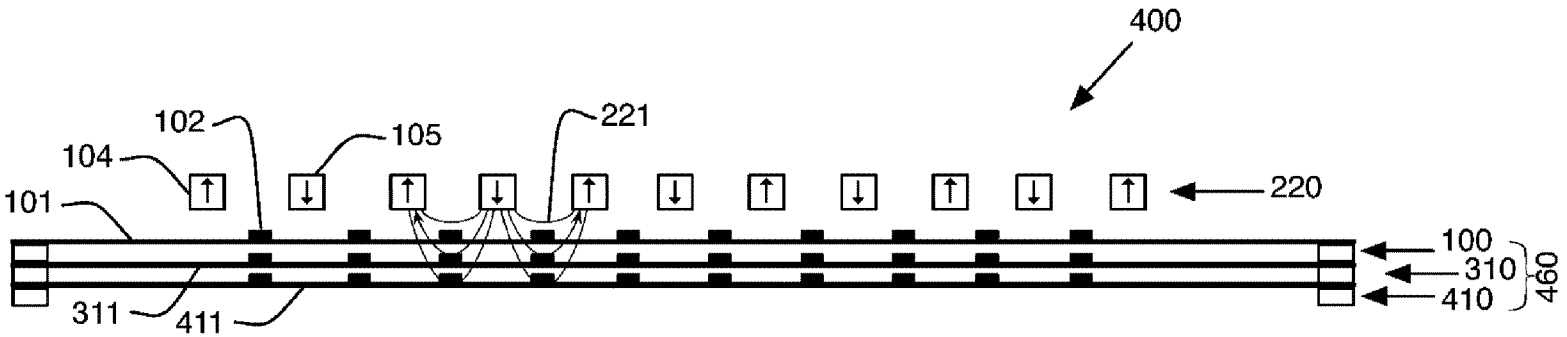
FIG. 4 shows a cross-section of one example multiple diaphragm assembly having three diaphragms positioned near a single planar magnet array, according to some aspects.

FIG. 4 shows another multi-diaphragm planar magnetic transducer 400, similar to transducer 300, but where multi-diaphragm module 460 has three diaphragm assemblies 100, 310, 410, in which the third diaphragm assembly 410 comprises substrate 411, according to some aspects.

Figure 5:
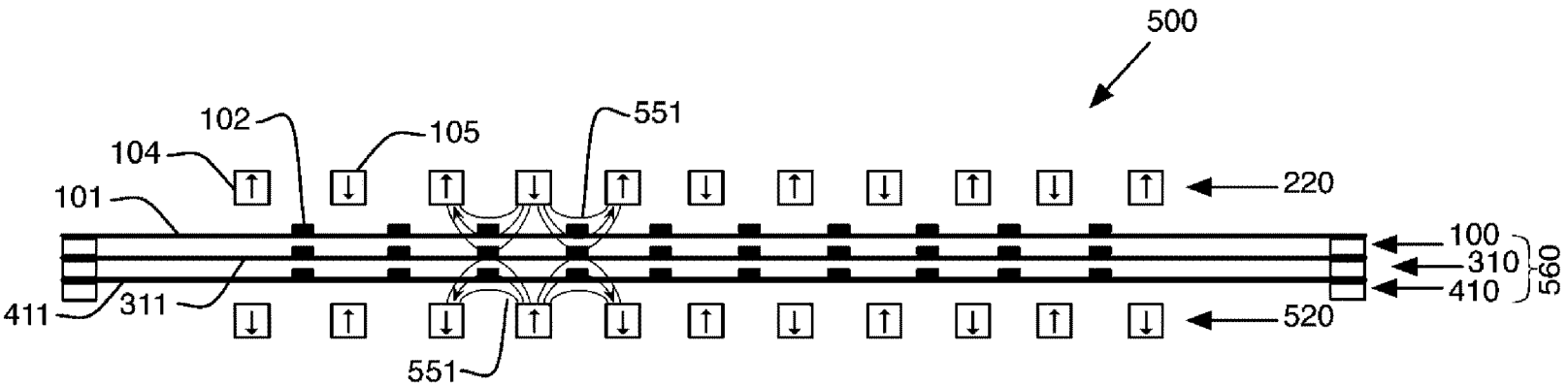
FIG. 5 shows a cross-section of another embodiment having a three-diaphragm assembly "inside" two planar magnetic arrays, that is, the diaphragms are positioned between the two planar magnetic arrays, according to some aspects.

In the configuration as shown in FIG. 4, diaphragm assembly 410 will encounter weaker regions of magnetic fields 221 than will the other diaphragm assemblies 100, 310, due to being further from planar magnetic array 200. In FIG. 5, the multi-diaphragm planar magnetic transducer 500 addresses this with the introduction of a second planar magnetic array 520 having a vertical arrangement. This second array 520 is aligned with, but opposed to, array 220, i.e., each individual magnet of array 520 is in opposition to the corresponding magnet of array 220, that is their mutual orientation is north-to-north, or south-to-south. As a result of the opposed magnets, the magnetic field 551 between the two arrays 220, 520 (e.g., in FIG. 5) is more intense than the magnetic field 221 imposed by array 220 along (e.g., in FIG. 4). The arrangement also makes more even the magnetic field imposed on the different diaphragm assemblies 100, 310, 410 of diaphragm module 560.

Figure 6:
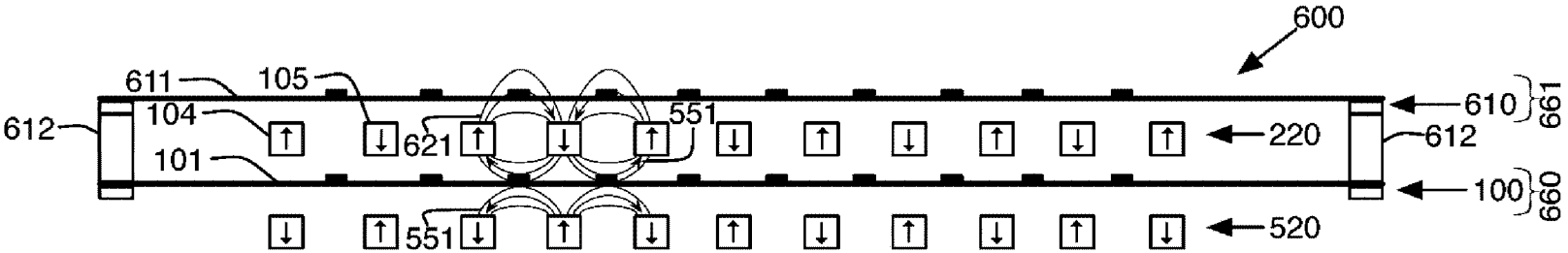
FIG. 6 shows a cross-section of an embodiment of a multi-diaphragm assembly having multiple planar magnetic arrays, wherein some diaphragms occupy an "inside position," that is, positioned between two magnetic arrays, and some diaphragms occupy an "outside position," that is, positioned near only one planar magnetic array, according to some aspects.

FIG. 6 shows a cross-section of an embodiment of a multi-diaphragm assembly having multiple planar magnetic arrays, wherein some diaphragms occupy an "inside position," that is, positioned between two magnetic arrays, and some diaphragms occupy an "outside position," that is, positioned near only one planar magnetic array, according to some aspects. More particularly, FIG. 6 shows multi-diaphragm planar magnetic transducer 600, according to some aspects, having diaphragm assemblies 100 (comprising substrate 101) and 610 (comprising substrate 611) on opposite sides of a single planar magnetic array 220. Diaphragm modules 660 and 661 comprise diaphragm assemblies 100 and 610, respectively. Frame 612 holds diaphragm modules 660, 661 apart and in position with respect to, and on opposite sides of, planar magnet array 220. Diaphragm modules 660, 661, and frame 612 are preferably substantially sealed, as previously discussed, to maintain the isobaric condition of the acoustic coupling between those diaphragm modules. In some aspects, frame 612 may also hold array 220 in position, as discussed above.

In multi-diaphragm planar magnetic transducer 600, diaphragm substrate 611 is immersed in the unopposed magnetic field 621 of planar magnet array 220, while substrate 101 is between opposing magnetic arrays 220, 520, and so is immersed in the more intense magnetic field 551.

Figure 7:
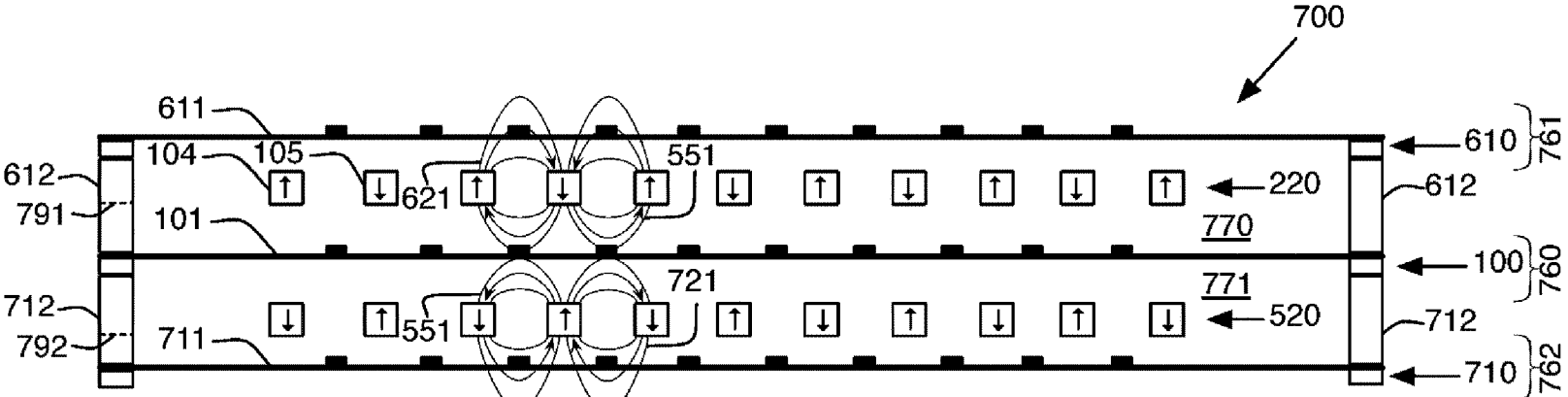
FIG. 7 shows a cross-section of an example multi-diaphragm, dual planar magnetic array assembly having an inside position and both outside positions occupied by at least one diaphragm, according to some aspects.

FIG. 7 shows a cross-section of an example multi-diaphragm, dual planar magnetic array assembly having an inside position and both outside positions occupied by at least one diaphragm, according to some aspects. More particularly, FIG. 7 shows multi-diaphragm planar magnetic transducer 700, in which three diaphragm modules 760, 761, 762 are provided, according to some aspects. The central diaphragm module 760 surrounded by two planar magnetic arrays 220 and 520, the arrays held by frames 612 and 712, respectively. Transducer 600 is capped on both ends by outer diaphragm modules 761, 762, each attached to one of frames 612 and 712, respectively. In this configuration, outer diaphragm modules 761, 762 are exposed to the weaker, unopposed magnetic fields 621, 721, while the inner diaphragm module 760 is embedded in the more intense opposed magnetic fields 551.

FIG. 7 also identifies chamber 770, contained by modules 760, 761, and frame 612; and chamber 771, contained by modules 760, 762, and frame 712. According to some aspects, venting is explicitly shown in FIG. 7 by ports 791 and 792, which allow the pressure within the chambers 770, 771 to equalize to atmospheric pressure. In other aspects, one or both of chambers 770, 771 may be completely sealed.

Figure 8:
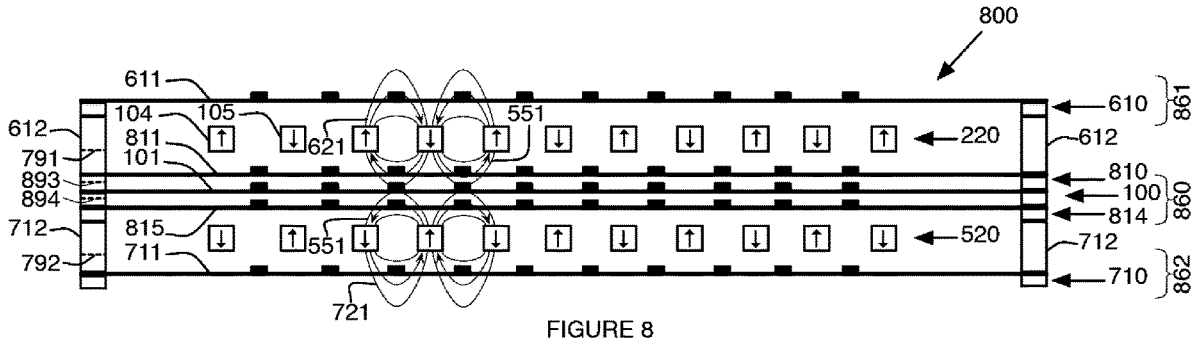
FIG. 8 shows a cross-section of a multi-diaphragm, dual magnetic array assembly having both outside positions occupied by at least one diaphragm, with some of the positions occupied by multiple diaphragms, according to some aspects.

FIG. 8 shows a cross-section of a multi-diaphragm, dual magnetic array assembly having both outside positions occupied by at least one diaphragm, with some of the positions occupied by multiple diaphragms, according to some aspects. More particularly, FIG. 8 shows a multi-diaphragm planar magnetic transducer 800 that is similarly configured as transducer 700, in which the inner diaphragm module 760 of transducer 700 is replaced by a multi-diaphragm module 860, comprising the three diaphragm assemblies 100, 810, 814, each respectively comprising diaphragm substrate 101, 811, 815. In this configuration, the more intense opposed magnetic field 551 is applied to more diaphragm assemblies (the three in inner diaphragm module 860) while the weaker, unopposed magnetic fields 621, 721 are applied to fewer diaphragm assemblies (the one each in outer diaphragm modules 861, 862, respectively).

Explicit venting, according to some aspects, is further shown in FIG. 8 where ports 893 and 894 allow the chambers formed between diaphragm substrates 101 and 811, and between substrates 101 and 815, to slowly equalize to atmospheric pressure. In other aspects, the chambers of the multi-diaphragm module 860 may be completely sealed.

Figure 9:
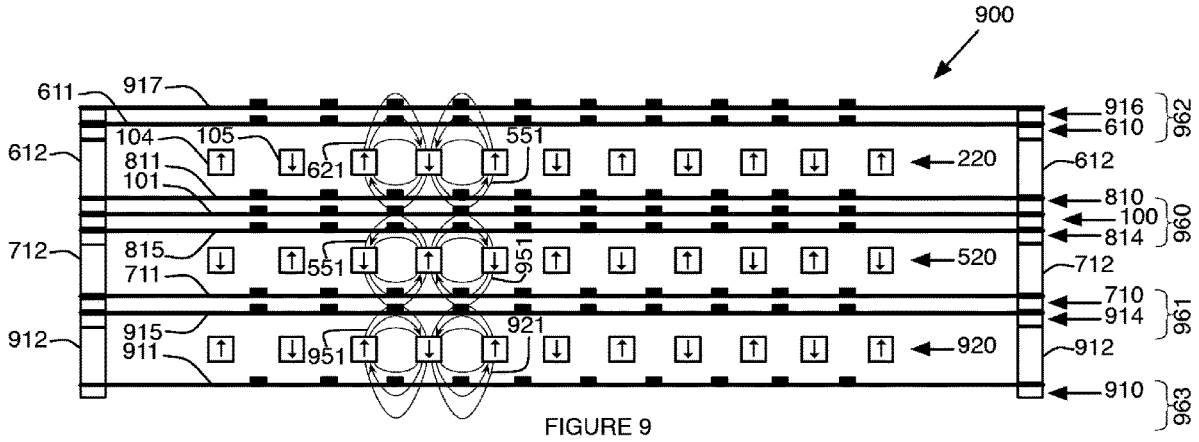
FIG. 9 shows a cross-section of a multi-diaphragm, multiple planar magnetic array assembly having multiple planar magnetic arrays, with at least one diaphragm at each of the inside and outside positions, according to some aspects.

FIG. 9 shows a cross-section of a multi-diaphragm, multiple planar magnetic array assembly having multiple planar magnetic arrays, with at least one diaphragm at each of the inside and outside positions, according to some aspects. More particularly, FIG. 9 shows multi-diaphragm planar magnetic transducer 900, having three planar magnetic arrays 220, 520, 920, two inner multi-diaphragm modules 960 (between arrays 220, 520) and 961 (between arrays 520, 920), and two outer diaphragm modules 962 (a multi-diaphragm module outside of array 220) and 963 (a single diaphragm module outside of array 920). Modules 960, 962, and array 220 are held in position by frame 612. Modules 960, 961, and array 520 are held in place by frame 712. Modules 961, 963, and array 920 are held in place by frame 912.

In this configuration, the more intense opposed magnetic fields 551 and 951 are applied to more diaphragm assemblies (the three in inner diaphragm module 960 and two in inner diaphragm module 961) while the weaker, unopposed magnetic fields 621, 921 are applied to fewer diaphragm assemblies (the one in outer diaphragm module 962, and two in outer diagram module 963). Diaphragm module 962 comprises diaphragm assemblies 916 and 610, which in turn comprise diaphragm substrates 917 and 611, respectively. As an outer module, diaphragm module 962 is exposed to unopposed magnetic field 621 imposed by planar magnetic array 220. Diaphragm module 960 comprises diaphragm assemblies 810, 100, 814 which in turn comprise diaphragm substrates 811, 101, 815, respectively. As an inner module, diaphragm module is exposed to the opposed magnetic field 551 imposed by planar magnetic arrays 220 and 520. Likewise, opposed magnetic field 951 from magnetic arrays 520 and 920 are imposed on inner diaphragm module 961, its component diaphragm assemblies 710, 914, and their respective diaphragm substrates 711, 915. Outer module 963 and its one diaphragm assembly 910 with substrate 911 is exposed only to the unopposed magnetic field 921 from array 920.

While the above examples shown in FIGS. 2 through 9 show various configurations of a particular number of diaphragm assemblies within a diaphragm module, and a particular number of diaphragm modules occupying inside or outside positions among a particular of number of planar magnetic arrays, it will be understood by those skilled in the art that the number of diaphragm assemblies within diaphragm modules may vary without departing from the scope and spirit of the disclosure. It will be further understood by those skilled in the art that the number of planar magnetic arrays within a planar magnetic transducer may vary without departing from the scope and spirit of the disclosure.

According to some aspects, individual chambers formed from the space enclosed by two diaphragm modules and a frame in a multi-diaphragm planar magnetic transducer, such as chamber 770, can be hermetically sealed, or multiple consecutive chambers may be, as a group, hermetically sealed. Chambers may be filled with ordinary air, preferably with humidity as low as possible, or may be filled with one or more gasses, e.g., nitrogen or carbon dioxide, selected for having low- or non-reactive properties with respect to the diaphragm substrate, the conductive circuit material, or any adhesives or structural materials used.

FIGS. 10-15 show different configurations for planar magnetic arrays that can be used in the planar magnetic transducers described above, according to some aspects, and approximations of the various magnetic fields produced by them.

Figure 10:
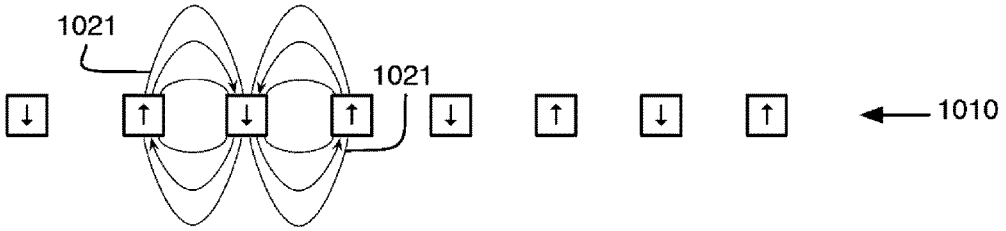
FIG. 10 shows a cross-section of a single magnetic array, such as those shown in FIGS. 1-4 and 18, wherein the poles of the magnets are aligned perpendicular to the plane of the array, according to some aspects.

FIG. 10 shows a single planar magnetic array 1010 in cross-section, similar to that in FIGS. 1-4 and 18, in which the magnetic axis of each individual magnet is perpendicular to the plane of array 1010, and consecutive magnets in the array alternate orientation, as shown by the arrows in the cross-section of each magnet. The resulting magnetic field 1021 is unopposed in both directions.

FIG. 11 shows dual planar magnetic array configuration 1100 similar to those in FIGS. 5-6, wherein a backing plate 1130 is also shown, according to some aspects. Dual planar magnetic array configuration 1100 comprises two planar magnetic arrays 1010 and 1110 that are mutually aligned, such that each magnet of array 1010 has a magnetic orientation that is the opposite of the corresponding magnet in array 1110. Accordingly, since the two magnetic arrays are opposed, the magnetic field 1151 between them is more intense. Also, the array 1110 is backed on one side by a plate 1130 made of a material having a low reluctance (as compared to free space), for which steel is a good choice and which has the effect of concentrating the outer magnetic field 1171 from array 1110. Plate 1130 can provide a mounting structure that is attached to, or is a part of a frame (e.g., 612 in FIG. 6) for holding the magnets of array 1110 aligned and in position. Note that as most of the outer magnetic field 1171 is routed within the material of plate 1130, planar magnetic array 1110 cannot be used to form an effective electro-acoustic transducer with an outer diaphragm substrate, that is, a diaphragm that would be on the other side of plate 1130 from array 1110, since there is no substantial magnetic field available to interact with a diaphragm assembly placed there.

According to some aspects, backing plate 1130 is perforated by holes (or slots) 1131, to allow air to freely pass between one side of planar magnet array 1110 and the other. The holes/slots are preferably aligned to be between the individual magnets of array 1110. A larger portion of open space (i.e., through the holes or slots), as by having larger diameters, or slot-widths and -lengths improves the acoustic transparency of the plate 1130, but increasing open space beyond a certain percentage of the space between the individual magnets of array 1110 will affect how well plate 1130 performs at containing magnetic field 1171. In some aspects, an aggregate opening through the holes of a range of 10-80% of the portion of plate 1130 exposed between or adjacent to the magnets of array 1110 is preferable when the backing material is steel, but more or less of an aggregate opening may be used. As smaller hole sizes may restrict acoustic flow, such a configuration may be selected to deliberately affect the resonances of the chamber formed by the backing plate and the nearest diaphragm. The plate 1130 also shields other portions of the transducer from external fields that might cause interference, and conversely helps to shield the transducer from outside fields that might affect its operation (e.g., by introducing extraneous signals). Plate 1130 also shields external devices from transducer magnetic field radiation.

Figure 12:
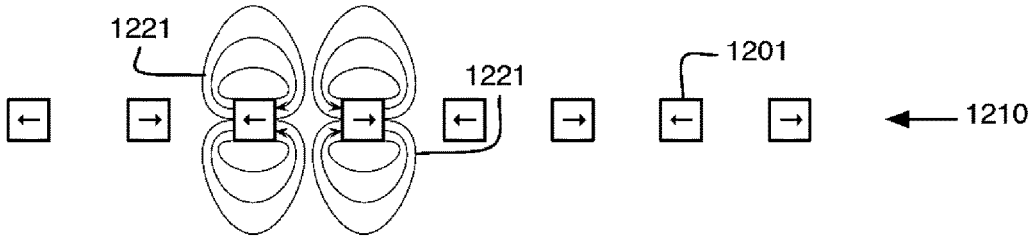
FIG. 12 shows a cross-section for a single magnetic array having the poles of the magnets aligned in the plane of the array, according to some aspects.

FIG. 12 shows a planar magnetic array 1210 comprising magnets, such as magnet 1201, each having a corresponding magnetic axis that is parallel to the plane of the array 1210 and parallel to the cross-section as shown, according to some aspects. Each magnet in array 1210 is arranged to have the opposite orientation as the adjacent magnet, and so the fields within the array, between the magnets, are alternating in south-to-south, north-to-north, south-to-south, etc. The arrangement of the planar magnet array as shown in FIG. 12 is hereinafter referred to as an "sideways arrangement," according to some aspects. In the single planar magnetic array configuration of FIG. 12, the magnetic field 1221 outside of the array 1210 is weaker than the field 1021 of array 1010 with reference to FIG. 10, but is advantageously more uniform with distance from plane of the array in the near-field (i.e., while still close to the array 1210). In a sideways arrangement, the appropriate alignment of the electrically conductive circuit is to be aligned with the centerline of each magnet, unlike in the vertical arrangement where the circuit (e.g., 102 in FIG. 2), is aligned with the middle of the space between the centerlines of consecutive magnets in the array.

Figure 13:
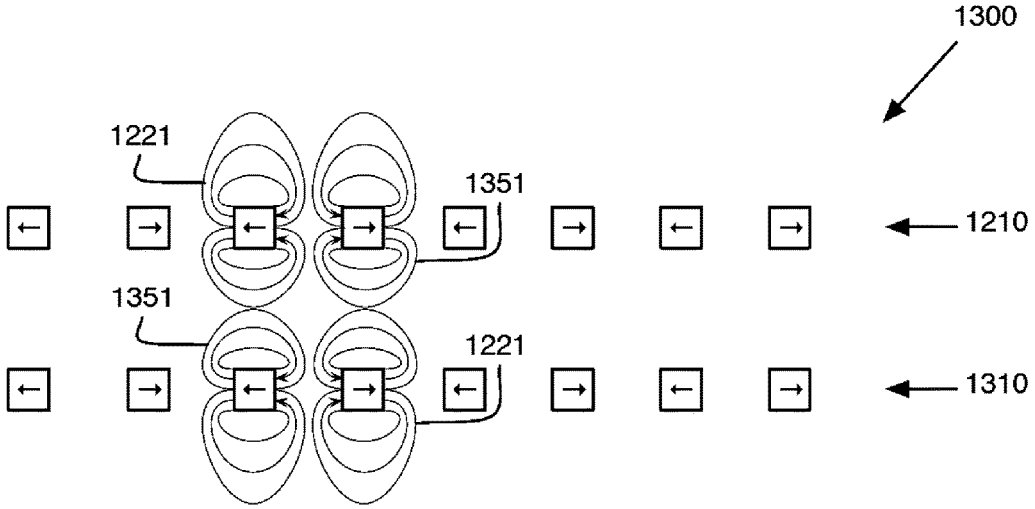
FIG. 13 shows a cross-section of a dual magnetic array having the poles of the magnets aligned in the plane of the array, according to some aspects.

FIG. 13 shows dual planar magnetic array configuration 1300 according to some aspects, in which two planar magnetic arrays 1210 and 1310 having the "sideways arrangement" are mutually aligned, with each magnet of one array (e.g., 1210) having a magnetic orientation that is the same as the corresponding magnet in the other array (e.g., 1310). Accordingly, when the field imposed by each of the corresponding magnets combines between the arrays 1210, 1310, the fields are opposed, making the net magnetic field 1351 between them more intense, however the improved linearity property remains substantially intact.

FIG. 14 shows dual planar magnetic array configuration 1400 according to some aspects, in which the two planar magnetic arrays 1410, 1420 both have the "sideways arrangement" and further comprise stators (e.g., 1402, 1403) on each of the magnets (e.g., 1401). The stators, sometimes called "pole pieces," are made of a material having low reluctance, as compared to free space, for which steel is a good choice. The stators serve to draw the magnetic fields 1421, 1451 closer into the arrays, making the field more intense at a position close to a planar magnetic array than would otherwise be without stators 1402, 1403.

An advantage of the "sideways arrangement" of transducer 1300 without stators is that the gaps between adjacent magnets are larger and thus represent an improved acoustic transparency of the planar magnet arrays 1210, 1310 as compared with to arrays 1410, 1420, which include stators. As stators are commonly made of steel, they also add weight, thus arrays 1210, 1310 are also typically lighter than those of arrays 1410, 1420.

Figure 15:
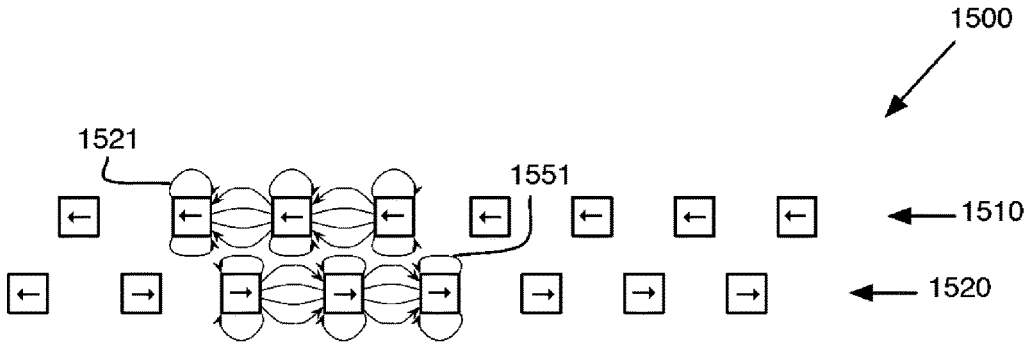
FIG. 15 shows a cross-section of a dual magnetic array where the poles of the magnets aligned in the plane of the array, but where the magnets in one array are staggered with respect to those in another, according to some aspects.

FIG. 15 shows a cross-section of a dual magnetic array where the poles of the magnets are aligned in the plane of the array, but where the fields within the array are aligned south-to-north, north-to-south, south-to-north, etc., and where the magnets in one array are staggered and oppositely oriented with respect to those in another array, according to some aspects. The arrangement as shown in FIG. 15 is hereinafter referred to as the "staggered arrangement" for multiple planar magnetic arrays. Dual planar magnetic array configuration 1500 comprise two planar magnetic arrays 1510 and 1520, each array having all of its magnets with the magnetic axes aligned in parallel with the plane of the array and parallel to the cross-section, as shown. Consecutive arrays have the opposite polarity, thus the north pole of all of the magnets of one array 1510 face in a direction opposite the direction faced by the north poles of the next array 1520. The name "staggered arrangement" comes from the fact that each magnet in an array (e.g., 1510) is not aligned with the corresponding magnet in the next array (e.g., 1520), but with a gap adjacent to the corresponding magnet. Outer fields 1521 are less intense than inner fields 1551. For the "staggered arrangement," the alignment of the electrically conductive circuit (not shown) on an inner or outer diaphragm is such that the conductors are best aligned with the centerline of each magnet taken perpendicular to the plane of the array in the cross-section shown. With reference to FIG. 15, the electrically conductive circuit for a diaphragm above array 1510 would be centered above each magnet of array 1510, and the electrically conductive circuit for a diaphragm below array 1520 would be centered below each magnet of array 1520. A particular advantage provided by the "staggered arrangement" is that the inner fields 1551 are particularly linear.

Other aspects employing the "staggered arrangement" can be provided wherein each of the magnets is further outfitted with stators (not shown).

Figure 16:
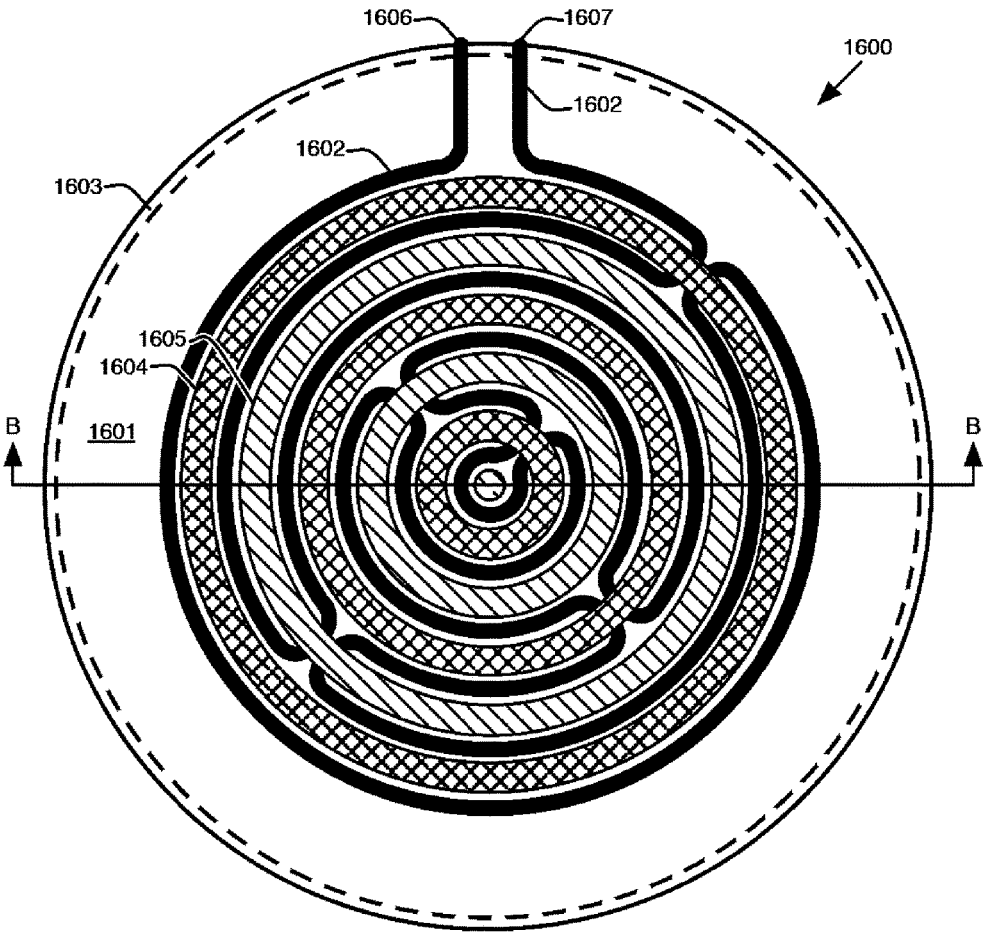
FIG. 16 shows an example of a single layer diaphragm assembly for a planar magnetic transducer having the diaphragm positioned near a concentric array of ring magnets, according to some aspects.

FIG. 16 shows an example of a single layer diaphragm assembly for a planar magnetic transducer having the diaphragm positioned near a concentric array of ring magnets, according to some aspects. More particularly, FIG. 16 a planar magnetic transducer in which the planar magnetic array, rather than being a linear array, is a concentric array. Each magnet in the array, e.g., magnets 1604, 1605, is a ring magnet (except when the center magnet is a cylinder, as shown). Here, the diaphragm assembly 1600 (which does not include the magnets) comprises diaphragm substrate 1601, electrically conductive circuit 1602, and frame 1603 (shown here to be on the far side of substrate 1601), to which the substrate 1601 is mounted. The magnets each have their magnetic axis perpendicular to the diaphragm assembly 1600, with consecutive magnets in the concentric array (e.g., 1604, 1605) having opposite polarities. Thus, ring magnet 1604 has its north pole facing out from the substrate 1601, while the next consecutive ring magnet 1605 has its north pole facing into substrate 1601, which puts this concentric planar magnetic array in the "vertical arrangement". The electrically conductive circuit 1602, in this configuration, traces out arcs aligned with the gaps between the magnets, except in areas where the circuit transitions to an adjacent gap. With each transition, the trace of the arcs changes direction. Leads or other attachment to the diaphragm assembly 1600 can be made at connection points 1606, 1607.

In some aspects, the electrically conductive circuit on the diaphragm can make more efficient use of the magnetic fields if made as a spiral with one end terminating at the center of the diaphragm and the other end at the periphery. In such an embodiment, the conductor at the center of the diaphragm can be pinched to a supporting structure (discussed below in conjunction with FIGS. 19 and 20) or terminated to a flexible lead (not shown).

Figure 17:
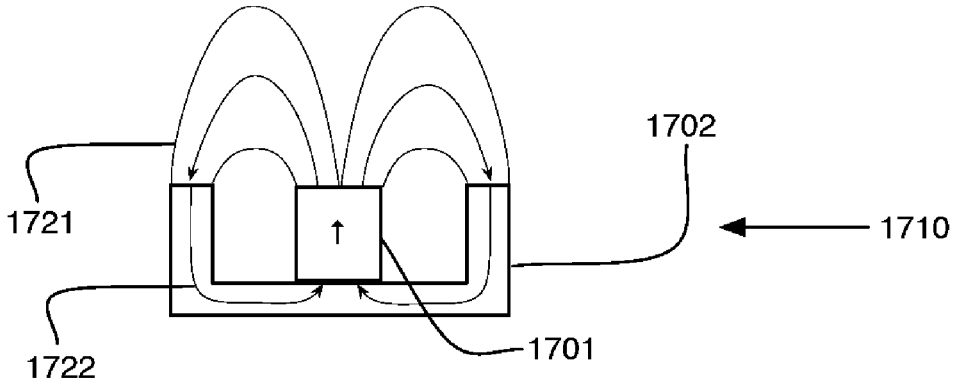
FIG. 17 shows a cross-section of a magnet array having at least one magnet combined with a U-shaped channel of low-reluctance material, according to some aspects.

FIG. 17 shows a cross section portion of a planar magnet array 1710 comprising at least one magnet 1701 each within a corresponding low-reluctance U-shaped channel piece 1702, according to some aspects. In this configuration, unopposed magnetic field 1721 is available to interact with a plurality of diaphragms arranged within a multi-diaphragm module, such as multi-diaphragm module 460 with reference to FIG. 4, wherein the low-reluctance channel completes the magnetic circuit by conducting the return field 1722.

Figure 18:
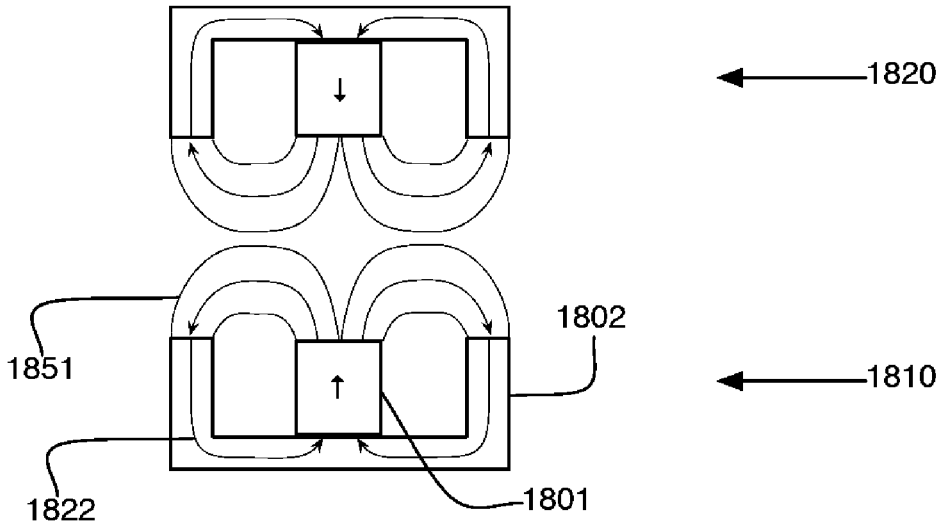
FIG. 18 shows a cross-section of a dual magnet array, each magnet array having at least one magnet combined with a U-shaped channel of low-reluctance material, according to some aspects.

FIG. 18 shows a cross-section portion of two similar planar magnet arrays 1810, 1820 arranged in opposition, wherein magnet 1801 in channel piece 1802 asserts accessible magnetic field 1851 that is opposed by the field generated by magnet array 1820. Magnetic field 1851 is suitable for use with a plurality of diaphragms arranged within a multi-diaphragm module, such as multi-diaphragm module 460 with reference to FIG. 4, while return field 1822 is largely within the body of the channel piece 1802. While the U-channel configurations of FIGS. 17 and 18 do not provide a magnetic field that is particularly uniform in the region above the gap between the magnet and the channel walls, the U-channel does offer an economical way to cover a large area with fewer magnets.

Note that FIGS. 17 and 18 the planar magnet arrays may be linear or circular, that is, FIGS. 17 and 18 may represent the cross-sections of either a linear (i.e., bar) magnet, in which case, the cross-section U-shaped channel pieces are also linear (that is, extrusions of the cross-section), or of a ring (i.e., annular) magnet, in which case the U-shaped channel pieces are solids of rotation about the vertical centerline of the cross-section. In some aspects, where the planar magnet arrays are either linear or circular, the channel pieces are perforated (perforations not shown) to allow propagation of sound waves in air to pass through the perforations in the channel pieces.

Figure 19:
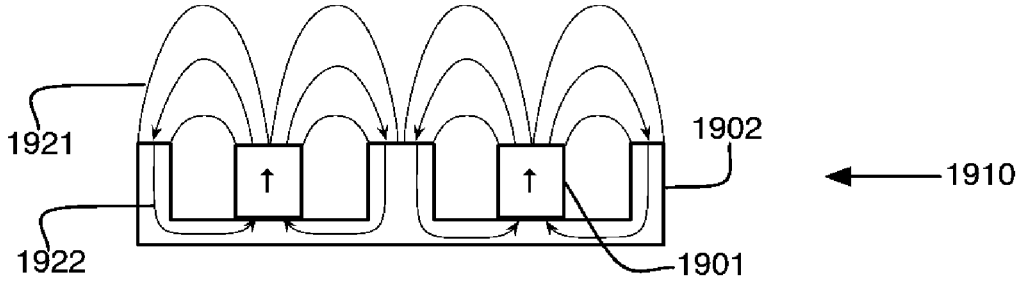
FIG. 19 shows a cross-section of a magnet array having a W-shaped channel of low-reluctance material, according to some aspects; and, FIG. 20 shows a cross-section of a dual magnet array, each magnet array having a W-shaped channel of low-reluctance material, according to some aspects.

FIG. 19 shows a cross-section of planar magnet array 1910, comprising one or more magnets, such as bar magnet 1901, each within a channel of a W-shaped, low reluctance channel piece 1902, according to some aspects. Here, magnet 1901 imposes unopposed fields, such as field 1921, and return fields, such as field 1922, where the return fields are conducted largely through the low reluctance material of channel piece 1902.

Figure 20:
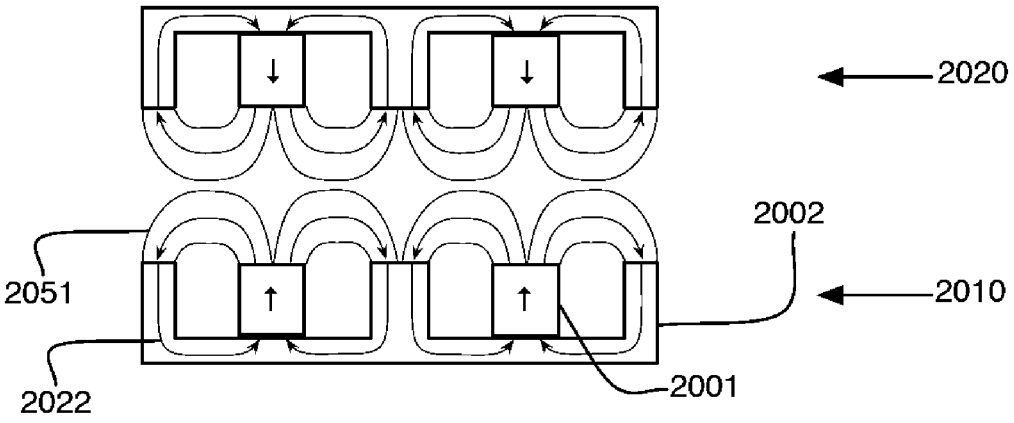

FIG. 20 shows a cross-section of two planar magnet arrays 2010, 2020, similar to planar magnet array 1910, in an opposed configuration, each planar magnet array using a W-shaped, low reluctance channel piece, such as channel piece 2002, according to some aspects. Here, the magnets, such as magnet 2001, generate accessible fields, such as field 2051 suitable for use with multiple diaphragms arranged within a multi-diaphragm module, such as multi-diaphragm module 460 with reference to FIG. 4. Field 2051 is more intense because of the corresponding opposing field. The returning field 2022 is largely contained within the low reluctance material of W-shaped channel pieces 2002.

As above, the cross-sections shown in FIGS. 19 and 20 can represent either linear magnet arrays (each comprising two bar magnets) with a channel piece that is an extrusion of the W-shaped cross-section, or a circular magnet array, each array having one ring (i.e., annular) magnet. In the case of an annular magnet array, the outer walls of the W-shaped channel piece are generally ring-shaped, while the central portion is generally cylinder-shaped. In either case, the W-shaped channel pieces are perforated to allow passage of sound waves in the air of the perforations within the W-shaped channel pieces. Also, the central portion of the W-shaped piece may be hollow to minimize material requirements without seriously compromising the magnetic saturation properties.

The cross sections shown in FIGS. 2-15 are applicable to the concentric configuration of FIG. 16 when viewed in cross-section at BB. Accordingly, configurations of FIGS. 2-15 can be achieved not only with a linear planar magnetic array (e.g., as shown in FIG. 1), but also with concentric arrays (e.g., as shown in FIG. 16), and indeed in other axisymmetric magnetic circuit designs.

In use, the multi-diaphragm planar magnetic transducers exhibit properties not provided in previous approaches.

For example, when each of the individual circuits in each of the multiple diaphragm transducers 300, 400, 500 are driven with the same in-phase signal, the acoustic output from each of the multiple diaphragms will reinforce that of the other(s), and allow the same planar magnetic array (or arrays) to deliver more power through the parallel multi-diaphragm modules.

As another example, with reference to FIG. 7, for use in noise cancelling headphones, outside diaphragm module 761 of multi-diaphragm transducer 700 can be monitored as an electro-acoustic detector, i.e., a microphone. Inside diaphragm module 760 could be driven by an audio output as a headphone transducer. The inside position of module 760 between two planar magnetic arrays 220, 520, make it particularly well-suited for audio output. The third outside diaphragm module 762 can be driven with a noise cancellation signal $O_{762}$ derived from the monitored signal from diaphragm module 761 and the output signal (or its source) delivered to diaphragm module 760. One example derivation for such a signal is shown here as EQ. 1:

$$O_{762}(t)=-a(I_{761}(t-2d)-b\ O_{760}(t-3d))$$

In which:

$I_{761}(t)$ is the input signal measured from diaphragm assembly 761 at time 't';

$O_{760}(t)$ is the output signal being sent to the diaphragm assembly 760 at time 't';

'd' is a delay value equal to the time-of-flight for sound traveling the distance between consecutive pairs of diaphragm substrates {611→101}, and {101→711}, here assumed to be equal, which may vary subtly in accordance with temperature, and perhaps the humidity if the chambers 770, 771 are ported;

'a' and 'b' are scale factors, empirically determined for a particular design of transducers and the monitor and drive electronics; and $O_{762}(t)$ is the noise cancellation signal to be output using transducer module 762.

In some aspects, the operations shown in EQ. 1 can be applied spectrally, that is, by separating each of the signals into bands (e.g., ⅓ octave), and processing the bands individually using EQ. 1, thereby allowing different bands to use different values for scale factors 'a' and 'b' for EQ. 1. For time 't', the noise cancellation signal that is outputted to transducer module 762 would be combined from the different applications of EQ. 1 for the different bands of input signal $I_{761}(t)$ and output signal $O_{760}(t)$ Such noise-cancellation processing by separate bands provides the advantage where, for example, due to its thickness, an input diaphragm is particularly sensitive to high frequencies, where the output diaphragm is not. In such configuration, the input diaphragm would read the high band as being a bit higher than a lower band. Providing different values for 'a' and 'b' in a high band and a low band would adjust the noise cancellation output $O_{760}(t)$ for such differences in sensitivity.

Some aspects may have different distances between consecutive diaphragm substrates. This can provide the advantage of consecutive chambers having different characteristic resonances and nulls, which can be particularly valuable at ultrasonic frequencies.

The foregoing description of preferred aspects of the present disclosure has been provided for the purposes of illustration and description. It is not intended to be exhaustive or to limit the disclosure to the precise forms disclosed. Various additional modifications of the described aspects of the disclosure specifically illustrated and described herein will be apparent to those skilled in the art, particularly in light of the teachings of this disclosure. It is intended that the disclosure cover all modifications and aspects, which fall within the spirit and scope of the disclosure. Thus, while preferred aspects of the present disclosure have been disclosed, it will be appreciated that it is not limited thereto but may be otherwise embodied within the scope of the following claims.

I claim:

1. A device comprising a first planar magnet array disposed on a frame, the first planar magnet array having a first planar side and a second planar side, the first planar magnet array producing a first magnetic field from the first planar side;

a plurality of diaphragms wherein each diaphragm of the plurality of diaphragms comprises a diaphragm substrate including at least one electrically conductive circuit, each circuit connectable to at least one of a driver and a detector, and each diaphragm of the plurality of diaphragms operable as at least one of a speaker and a microphone;

a first diaphragm of the plurality of diaphragms disposed tautly on the frame, the first diaphragm positioned parallel to and in alignment with the first planar side of the first planar magnet array, such that the at least one electrically conductive circuit of the first diaphragm is suspended in the first magnetic field of the first planar magnet array; and a second diaphragm of the plurality of diaphragms disposed tautly on the frame, the second diaphragm positioned parallel to and in alignment with the first diaphragm, such that the first diaphragm is positioned between the second diaphragm and the first planar magnet array, whereby the at least one electrically conductive circuit of the second diaphragm is suspended in the first magnetic field of the first planar magnet array, wherein a space is formed between the first diaphragm and the second diaphragm, such that the space is magnet-free.

2. The device of claim 1, wherein the space formed between the first diaphragm and the second diaphragm comprises only air and magnetic fields.

3. The device of claim 1, wherein the frame comprises a first planar magnet array frame and one or more frames for the plurality of diaphragms.

4. The device of claim 1, further comprising a first set of one or more diaphragms of the plurality of diaphragms wherein the first set of one or more diaphragms is disposed tautly on the frame positioned parallel to and in alignment with the second diaphragm, such that the second diaphragm and the first diaphragm are positioned between the first set of one or more diaphragms and the first planar magnet array, whereby the at least one electrically conductive circuit of the first set of one or more diaphragms is suspended in the first magnetic field of the first planar magnet array.

5. The device of claim 1, wherein one or more spaces are formed between the second diaphragm and the first set of one or more diaphragms such that the one or more spaces are magnet-free.

6. The device of claim 5, wherein at least one of the one or more spaces comprises a port operable for pressure equalization.

7. The device of claim 1, further comprising a second planar magnet array disposed on the frame, the second planar magnet array having a third planar side and a fourth planar side, the second planar magnet array producing a second magnetic field from the third planar side, whereby the at least one electrically conductive circuit of the second diaphragm is suspended in the second magnetic field of the second planar magnet array.

8. The device of claim 7, wherein the at least one electrically conductive circuit of the first diaphragm is suspended in the second magnetic field of the second planar magnet array.

9. The device of claim 8, further comprising a second set of one or more diaphragms of the plurality of diaphragms wherein the second set of one or more diaphragms is disposed tautly on the frame positioned parallel to and in alignment with the second diaphragm, and wherein the second set of one or more diaphragms is positioned between the second planar magnetic array and the second diaphragm such that the at least one electrically conductive circuit of the second set of one or more diaphragms is suspended in the second magnetic field of the second planar magnet array.

10. The device of claim 1, wherein at least one diaphragm of the plurality of diaphragms is operable as a microphone.

11. The device of claim 1, wherein at least one diaphragm of the plurality of diaphragms is operable as a noise cancellation microphone.

12. The device of claim 11, wherein a signal from the at least one diaphragm of the plurality of diaphragms operable as a noise cancellation microphone is spectrally separated into bands.

* * * * *